United States Patent [19]

Olewska

[11] Patent Number: 4,959,942

[45] Date of Patent: Oct. 2, 1990

[54] METHOD AND SYSTEM FOR PREPARING AN EXHIBITION SPACE

[75] Inventor: Anna Olewska, Krakow, Poland

[73] Assignee: Dolmen Engineering & Systems Ltd., Great Britain

[21] Appl. No.: 432,360

[22] Filed: Nov. 6, 1989

Related U.S. Application Data

[63] Continuation of Ser. No. 141,568, Jan. 6, 1988, abandoned.

[30] Foreign Application Priority Data

Jan. 8, 1987 [EP] European Pat. Off. ..... 87100168.1

[51] Int. Cl.[5] ..... E04G 21/00

[52] U.S. Cl. ..... 52/745; 52/29; 52/33

[58] Field of Search ..... 52/39, 33, 29, 64, 745, 52/22

[56] References Cited

U.S. PATENT DOCUMENTS

| | | | |
|---|---|---|---|
| 1,988,260 | 1/1935 | Berghoff | 52/64 |
| 3,181,274 | 5/1965 | Izenour | 52/29 |
| 3,683,100 | 8/1972 | Deal | 52/64 |
| 3,685,235 | 8/1972 | Lang | 52/39 |
| 3,736,706 | 6/1973 | Stephenson | 52/39 |
| 4,006,567 | 2/1977 | Flannery | 52/29 |
| 4,037,385 | 7/1977 | Wahlquist | 52/39 |

FOREIGN PATENT DOCUMENTS

| | | | |
|---|---|---|---|
| 039141 | 3/1981 | European Pat. Off. . | |
| 2158628 | 10/1971 | France . | |
| 2522050 | 2/1982 | France . | |
| 418597 | 2/1967 | Switzerland | 52/39 |
| 537502 | 12/1971 | Switzerland . | |
| 1590306 | 5/1981 | United Kingdom . | |
| 2186483 | 8/1987 | United Kingdom | 52/39 |

*Primary Examiner*—Henry E. Raduazo

*Attorney, Agent, or Firm*—Lerner, David, Littenberg, Krumholz & Mentlik

[57] ABSTRACT

The invention relates to a method and system for preparing exhibition or fair common spaces or passages. A permanent frame is foreseen which can be lifted and lowered respectively in a stand-by, not hindering higher position and in an operative position at a desired height over the floor. The frame can removably carry ceiling elements, signalling elements and/or lighting means in order to mate with the look and practical requirements of each particular exhibition.

4 Claims, 3 Drawing Sheets

25
25
24

22
13
10
21
20
23
19
19
10'
26

12

10
11
14
11

17
18

10
15
11
14

18
16

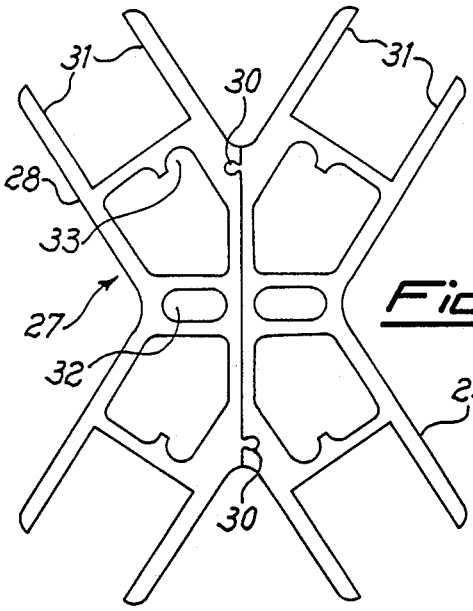
Fig.6
Fig.7
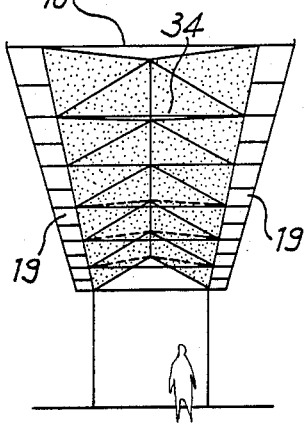
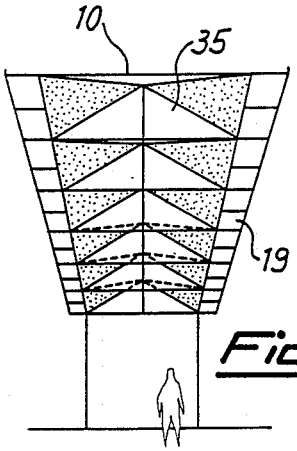
Fig.8
Fig.9
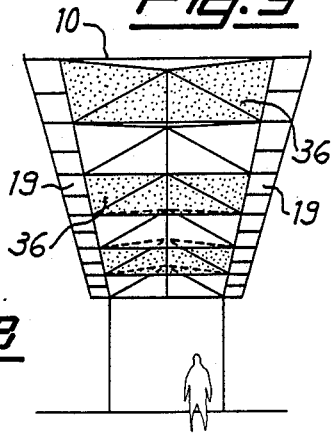
Fig.10
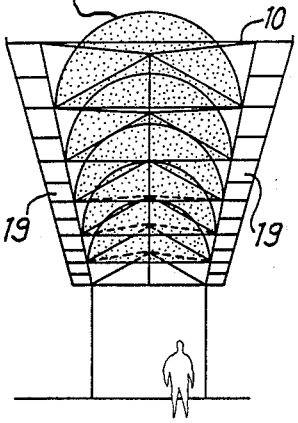
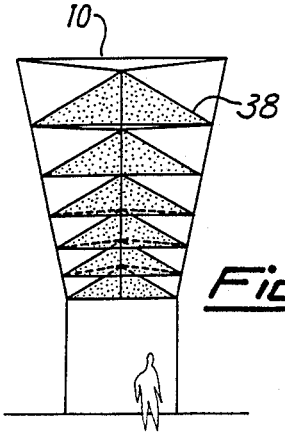
Fig.11
Fig.12
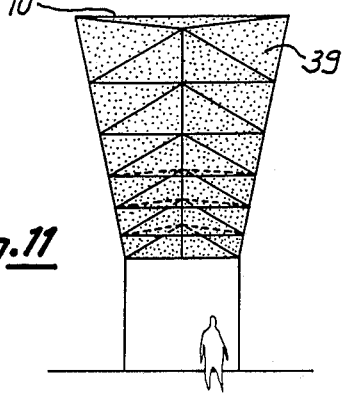
Fig.13
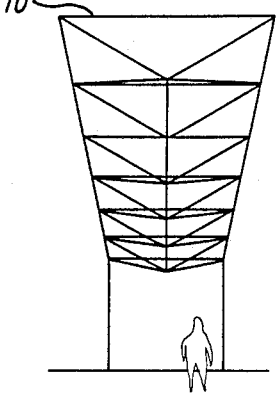

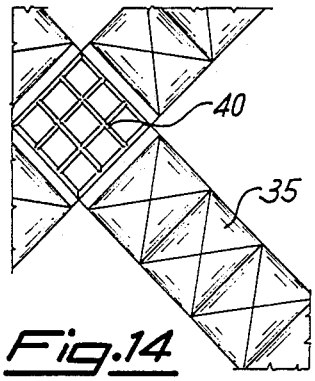
Fig.14
Fig.15
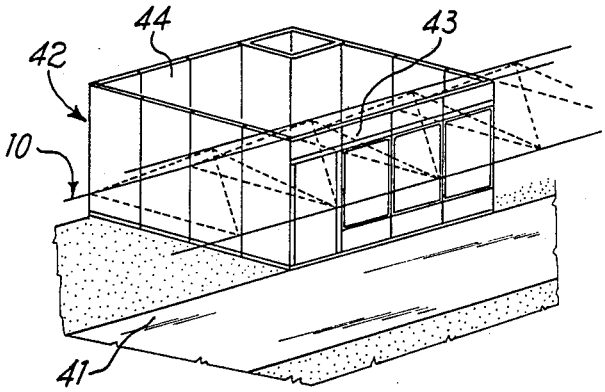
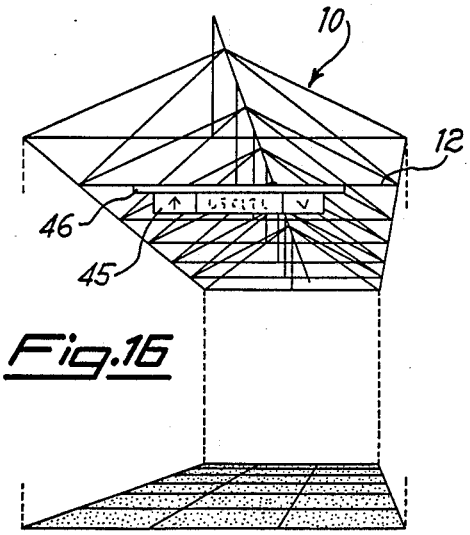
Fig.16
Fig.17
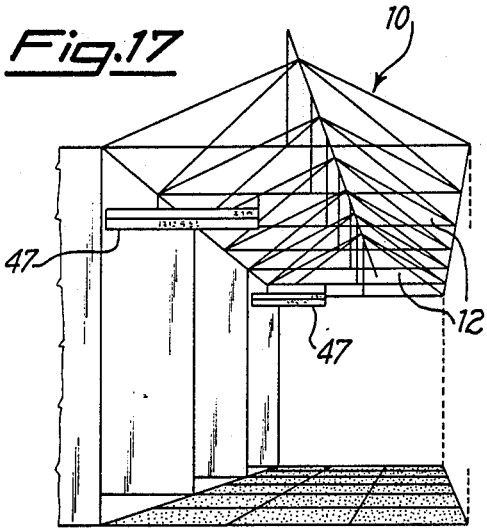
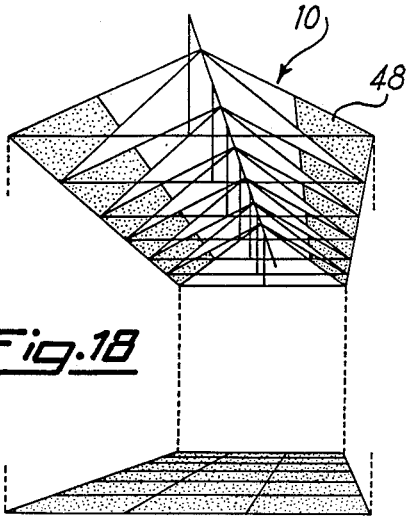
Fig.18
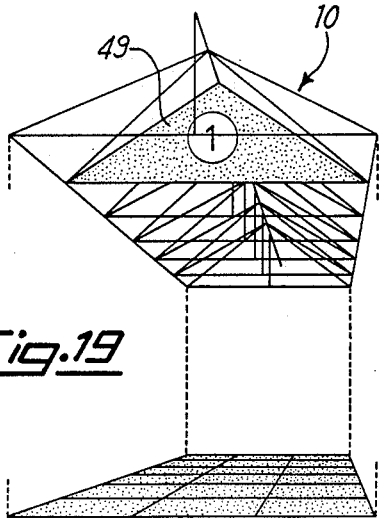
Fig.19

METHOD AND SYSTEM FOR PREPARING AN EXHIBITION SPACE

This is a continuation of application Ser. No. 07/141,568 filed Jan. 6, 1988 now abandoned.

BACKGROUND OF THE INVENTION

1. Field of the Invention

This invention relates to a method and system for preparing an exhibition or fair space within a building or in any case under a roof covering or the like.

2. Description of the Prior Art

Exhibitions are generally carried-out within large buildings, generally in the form of sheds of the like, wherein stands, passages between stands, common spaces and services are arranged. While stands are prepared by the single exhibitors, passages between stands, common spaces and services are usually prepared by the fair promoter. Services are normally permanent structures, while the common spaces and passages must be changed at every exhibition not in their location but in their appearance, both for look and practical purposes. In fact each exhibition must have a different look according to different requirements, for instance as the form and location of signalling elements and lighting means.

When the fair promoter leaves uncovered the shed roof or the like, aesthetical problems may arise as this roof is usually too far from the fair floor, as well as practical problems to sustain in the required positions said signalling elements and light means by uprights or the like. If, on the contrary, the fair promoter covers the roof of said buildings by means of a ceiling, this solves the above aesthitical and practical problems, but involves high costs for a full coverage and a heavy work to assemble and then disassemble a ceiling suitable for each particular fair. Such a ceiling is usually mounted at a height over the floor which is lower than that required for the movement of vehicles carrying the stand furnishing components and the exhibited objects, so that the ceiling assembling and disassembling operations must be made respectively after and before the stand preparation and dismantlement, with substantial time losses and difficulties for all exhibitors.

SUMMARY OF THE INVENTION

An object of this invention is then to provide a method and a system to overcome the above drawbacks of the known fair preparations, allowing to obtain in a simple, not expensive and time saving manner, both a required aesthetical appearance and a required location and form of the signalling elements and lighting means. Said aesthetical appearance, said elements form and location can be rapidly changed according to each fair requirements, without any actual limitation, as well as without undue excessive charge of work, time and costs.

Accordingly, this invention concerns a method for preparing an exhibition or fair space within a building or under a roof covering or the like, characterized in that it comprises the steps of:

pre-setting a plurality of supporting frames in correspondence with the common spaces and/or passages between stands, each said supporting frame being independently sustainded by said roof covering through cables or ropes, and means to controllably lift or lower each supporting frame being provided for;

lowering said supporting frames from a stand-by position near the roof covering to an operating position at a prefixed distance from the fair floor;

removably fixing, to at least a number of said supporting frames, ceiling elements and/or signalling elements and/or lighting means.

Moreover, the invention concerns a system for preparing a fair or exhibition under a roof or the like, characterized in that it comprises a plurality of supporting frames placed in the passages between stands and/or the common spaces, each of said frames being independently sustained to said roof by means of cables or ropes, and in that means are provided for controllably lift or lower each supporting frame.

The different features and advantages of the invention will be now more detailedly described with reference to embodiments thereof as shown in the enclosed drawings, wherein:

BRIEF DESCRIPTION OF THE DRAWINGS

FIG. 6 is a view from the bottom showing a preferred embodiment of a joint between profiles according to FIGS. 4 and 5.

FIGS. 7 and 13 are diagrammatic perspective front views of possible embodiments of ceiling elements as removably fixed to the truss of FIG. 1.

FIG. 14 is a plan view showing a crossing between two passages as prepared according to the invention.

FIG. 15 is a diagrammatic perspective view showing an embodiment of the invention when used in connection with an exhibition stand.

FIGS. 16 to 19 are diagrammatic perspective front views showing possible forms and locations of signalling elements and lighting means.

FIG. 20 is a diagrammatic perspective front view showing a number of the frames of the present invention in conjunction with a number of passages and stands in an enclosure.

DESCRIPTION OF THE PREFERRED EMBODIMENTS

Figure 1:
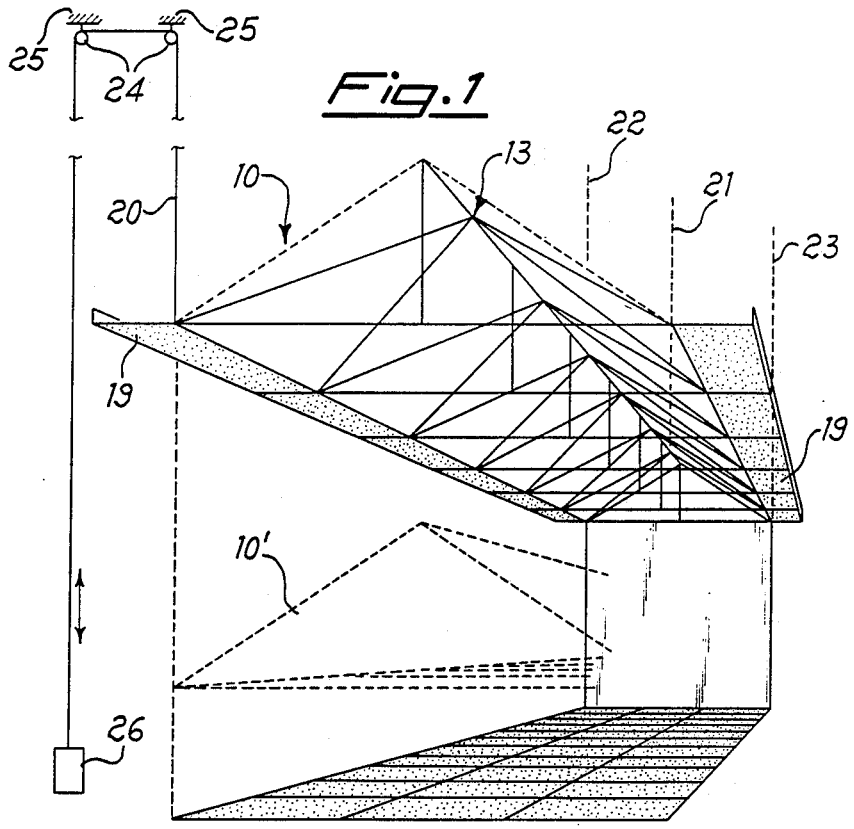
FIG. 1 is a perspective diagrammatic view of an embodiment of the present invention.
Figure 2:
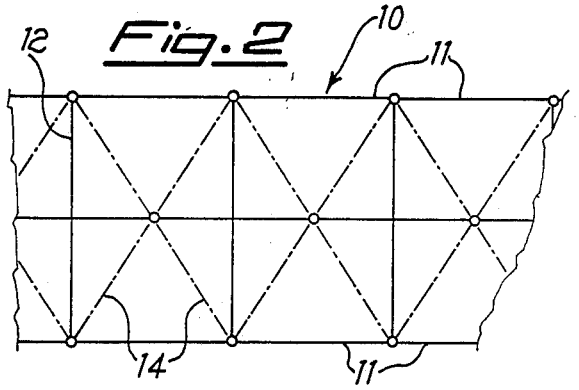
FIGS. 2 and 3 are a plan view and respectively a side view of the embodiment of FIG. 1.
Figure 4:
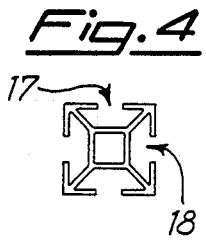
FIGS. 4 and 5 are cross-sectional views of possible profiles as used to form the truss of FIGS. 1 to 3.
Figure 3:
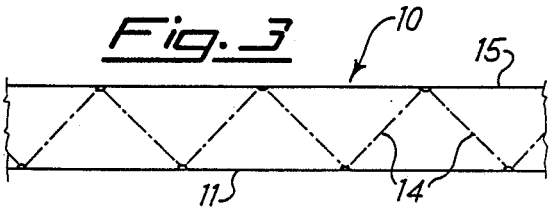
Figure 5:
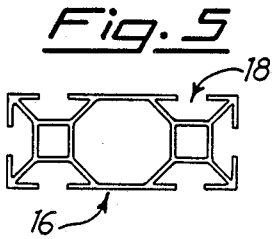

Referring firstly to FIGS. 1 to 3, a supporting frame 10 is shown therein, which is preferably in the form of a beam or truss made by profiles, for instance aluminum profiles, defining a rectangular planar base with longitudinal profiles 11 and transverse profiles 12, as well as a series of pyramidal elements 13, which are defined by slanting profiles 14 and are connected by an upper longitudinal profile 15. Preferably, at least the base transverse profiles 12 and maybe also the base longitudinal profiles 11 have a cross section as that shown at 16 in FIG. 5, while the other profiles have a cross section as that shown at 17 in FIG. 4. Both these sections show longitudinal grooves 18 wherein ceiling elements, signalling elements and/or lighting means can be removably fixed. The methods for fixing any type of element or means to said profile grooves 18 are well known in the art.

According to a preferred embodiment said profiles 11, 12, 14 and 15 are mounted and fixed together by means of specially shaped joints, an example of which is shown in FIG. 6. Such joint 27 is made by two identical parts 28 and 29, joined together by snap pin and seat arrangements as shown at 30. At the ends of frame 10, half-joints 28 or 29 are used for fixing the profiles. Each joint 27 has four double tongues 31 adapted to retain the ends of profiles, for instance using bolts, through screws or the like, as well as a plurality of through bores or openings 32 and 33 adapted to fix, by means of a screw, bolt or the like, the joint itself to a supporting profile, as a base profile 11 or 12.

As shown in FIG. 1, the frame 10, if necessary together with sidewardly protruding tongues 19, covers a length of a passage between fair stands, the whole passage being able to be covered by a series of frames 10 placed end to end with one another, preferably in an independent way.

The four outer corners of each frame base as sustained to the building roof 50 by means of cables or ropes 20–23 , which pass on pulleys 24 fixed as in 25 to said roof 50 and are independently or jointly controlled by a lifting and lowering device, as for instance a motor winch or the like, as diagrammatically shown at 26 for rope 20, in such a manner that each of said frames 10 shown in FIG. 20 can be lifted, lowered or even slanted at will.

Usually, during periods in which the fair is closed, said frames 10 are kept in a stand-by upper position, near the roof pulleys 24, in such a manner not to hinder any operation which can be made at the roof level, for instance all operations as necessary to prepare the stand furniture require a vehicle traffic, which can be carried out without problems relating to the vehicle height, on condition of course that the roof is sufficiently far from floor, as usually happens in sheds or the like.

When the above operations and in particular the vehicle traffic is over or before this traffic will start, said frames 10 can be lowered, all together or preferably one at a time, at a height allowing an easy fastening operation thereto of ceiling elements and/or signalling elements and/or lighting means. It is particularly advantageous to lower each frame 10, by means of ropes 20–23 and devices 26, up to man height as shown at 10' in FIG. 1, so to allow such operations in the easiest way, without the need of stepladders and so on. When all required ceiling, signalling and lighting elements are mounted, the frames can be lifted again in their stand-by position and, when all is ready, they are placed at the required height as shown by 10 in FIG. 10, which height is usually lower than the roof height, and are kept in this position for the whole fair period. At the end of this period, the exhibition dismantlement can be carried-out following an inverted procedure with reference to the above described one.

As previously said, the frames can removably carry different ceiling elements to obtain different looks of passages. Such ceiling elements may be rigid plates but preferably they are in the form of flexible, for instance suitably cut textile or plastics sheets which are placed to cover the frame slanting sides to obtain a span look as at 34 in FIG. 7, wherein side tongues 19 are provided too. In FIG. 8, the ceiling elements 35 cover the walls of each pyramidal protrusion 13, while in FIG. 9 alternate planar ceiling elements 36 are placed on frame 10. It is also possible to obtain a vault look (FIG. 10) by means of curved ceiling elements 37 or a triangle look (FIG. 11) by means of vertically placed triangular ceiling elements 38. In FIG. 12 the base of frame 10 is completely covered by plane ceiling elements 39 and in FIG. 13 the frame is placed in a reversed position 10".

From the above examples it can be seen that the shapes, sizes and fixing features of the ceiling elements can be modified at will, so that actually infinite look variations are possible.

FIG. 14 shows a passage crossing as seen from the bottom, wherein ceiling elements 35 according to a pyramidal look are foreseen and a special crossing ceiling part 40 is provided for.

FIG. 15 is a perspective view of a frame 10 with triangle looking ceiling elements 38, which is placed over a passage floor 41 between stands, one of which is shown at 42 in FIG. 15, and a number of which are shown in FIG. 20. It is to be noted that said stand 42 has a passage wall 43, the upper end of which can be removably fixed to the longitudinal profiles 11 of frame base. This wall 43 can be maintained in its vertical position by its connection with the other stand walls 44, or by said connection thereof to the frame base. It is to be understood that instead of (or besides) a stand wall, stand uprights can be provided for, which are connected or not to the frame base.

FIGS. 16 to 19 show some ones amongst the different possible choices as to arrange signalling elements and lighting means in connection with a frame 10 according to the invention. In FIG. 16 a central sign-board 45 is mounted on a transverse profile 12, preferably together with a related lighting means 46, while FIG. 17 shows sidewardly mounted sign-boards 47. Finally FIGS. 18 and 19 show that the same ceiling elements can be used as signalling means, as indicated with 48 and 49.

As previously said, any lighting means can be mounted on frame 10, using the profile grooves 18, while the required current can be fed thereto by means of cables concealed in the profiles or by means of a metal enclosed bus duct (not shown) which can be fixed to one or more profiles or forming itself a profile.

I claim:

1. A method for preparing an exhibition space within a roof enclosure containing a floor and a plurality of exhibition stands and passages between said plurality of exhibition stands comprising:

a. providing a plurality of supporting frames at locations within said roof enclosure substantially corresponding only to said passages, each of said plurality of supporting frames being independently supported from said roof enclosure by means of adjustable cable means whereby said plurality of supporting frames can be independently raised and lowered;

b. removably fixing mountable means to said plurality of supporting frames at predetermined locations on said plurality of supporting frames corresponding to predetermined positions in said passages, said mountable means being selected from the group consisting of ceiling elements, signalling elements, and lighting elements c. raising said plurality of supporting frames to an elevated standby position proximate to said roof enclosure; and d. lowering said plurality of supporting frames to an operating position at a predetermined distance from the floor of said exhibition space corresponding to said passages.

2. The method of claim 1 including removably connecting said plurality of supporting frames to predetermined portions of said roof enclosure.

3. The method of claim 1 including raising said plurality of supporting frames to permit vehicular traffic to use said passages.

4. The method of claim 1 including maintaining said plurality of supporting frames at a temporary height adjacent to the floor of said exhibition space to facilitate said removal of said mounted means.

* * * * *

UNITED STATES PATENT AND TRADEMARK OFFICE

CERTIFICATE OF CORRECTION

PATENT NO. : 4,959,942

DATED : October 2, 1990

INVENTOR(S) : Olewska

It is certified that error appears in the above-identified patent and that said Letters Patent is hereby corrected as shown below:

Column 2, line 32, delete "and" and insert therefor --to--.

Column 3, line 32, after "furniture", insert --as well as the objects to be exhibited. Such operations--.

Signed and Sealed this

Twenty-eighth Day of January, 1992

*Attest:*

*Attesting Officer*

HARRY F. MANBECK, JR.

*Commissioner of Patents and Trademarks*